US005427471A

United States Patent [19]

Godbersen

[11] Patent Number: 5,427,471

[45] Date of Patent: Jun. 27, 1995

[54] DOCK MOUNTED BOAT HOIST

[76] Inventor: Byron I. Godbersen, Lake LaJune Estates, Ida Grove, Iowa 51445

[21] Appl. No.: 191,210

[22] Filed: Feb. 3, 1994

[51] Int. Cl.[6] ..... B63C 1/00

[52] U.S. Cl. ..... 405/3; 114/48; 187/213; 187/266; 414/678

[58] Field of Search ..... 405/1, 2, 3; 114/44, 114/48, 51, 366; 187/213, 266; 414/678

[56] References Cited

U.S. PATENT DOCUMENTS

| | | | |
|---|---|---|---|
| Re. 32,118 | 4/1986 | Godbersen . | |
| 3,168,955 | 2/1965 | Black | 114/366 X |
| 3,402,828 | 9/1968 | Vilter . | |
| 3,697,048 | 10/1972 | Sarno | 187/266 X |
| 4,109,896 | 8/1978 | Ragen | 187/213 X |
| 4,509,446 | 4/1985 | Sutton | 405/3 X |
| 4,595,313 | 6/1986 | Kotke | 405/2 |
| 4,678,366 | 7/1987 | Williamson | 405/3 |
| 4,686,920 | 8/1987 | Thomas | 405/3 |
| 4,787,327 | 11/1988 | Porter | 114/44 |
| 4,900,187 | 2/1990 | Uchida et al. | 405/3 |
| 4,983,067 | 1/1991 | Montgomery | 405/3 |
| 5,090,841 | 2/1992 | Penick et al. | 405/3 |
| 5,140,923 | 8/1992 | Wood | 114/48 |
| 5,245,940 | 9/1993 | Rockwood | 114/48 |
| 5,311,970 | 5/1994 | Basta | 114/44 X |

FOREIGN PATENT DOCUMENTS

| | | | |
|---|---|---|---|
| 1336630 | 7/1963 | France | 405/2 |
| 1118581 | 10/1984 | U.S.S.R. | 405/3 |

*Primary Examiner*—Randolph A. Reese
*Assistant Examiner*—John A. Ricci
*Attorney, Agent, or Firm*—Henderson & Sturm

[57] ABSTRACT

A boat lift includes a vertical main post mounted on a dock, the lower end of the main post inserted into a body of water adjacent the dock and with the lower end spaced above the floor of the water. A frame includes an outer guide post having a base mounted on the water floor with an upper end above the water level; the frame connected by a single member to the main post. A platform unit for supporting a small boat is slidably connected at both ends to the main post and the guide post, and a cable and winch unit is interconnected among the foregoing elements for effecting a level lifting and lowering of the platform unit into and out of the water.

7 Claims, 4 Drawing Sheets

DOCK MOUNTED BOAT HOIST

TECHNICAL FIELD

This invention relates generally to boat hoists and more particularly to a boat hoist designed for attachment to a pier or dock.

BACKGROUND OF THE INVENTION

Conventional boat hoists in the main include a number of submerged vertical posts comprising a framework which rests upon the floor of the water about the hoist, and with a platform mounted in relation to all of the posts for supporting a boat thereon and movable upwardly and downwardly on the posts by means of a winch and cable assembly.

With the advent of smaller boats generally termed personal watercraft, one trade name being a JET SKI, it has been found that less complicated and smaller hoists may be utilized in connection with an adjacent pier or dock for stability of support. This type boat hoist may be readily installed and removed for ease of use.

The prior art in this field shows, for example, a single dock mounted post the lower end of which is supported on the water floor and a wheel assembly for rolling an H-platform up and down in U.S. Pat. No. 4,678,366. A later U.S. Pat. No. 4,983,067 discloses a vertical post for placement on the water floor and also to an adjacent dock, a lift cradle similar to a fork lift arrangement movably mounted on the post by a winch and cable arrangement.

A most recent patent, U.S. Pat. No. 5,245,940 again shows a vertical post driven into the bottom of the body of water, a platform rollably mounted for vertical movement on the post as by a cable arrangement, but again with a rather large and cumbersome H-type platform. It is evident, therefore that various areas of improvement exist in this relatively new field of boat lifts or hoists.

SUMMARY OF THE INVENTION

The present invention comprises a boat hoist for a personal watercraft having a main vertical post secured to an adjacent pier or dock, with the lower end of the main post spaced above the bottom of the water; a framework including an outer post having an upper end out of the water and a lower end resting on the water bottom, and a member interconnecting the main post and the outer post such that the member extends outwardly from the dock at substantially right angles therewith; a watercraft supporting unit mounted on a single platform element with opposite ends slidably supported on the main and outer posts; and a winch and cable arrangement interconnected among these components for effecting a raising and lowering of the platform and supporting unit between a lowered position within the water to a raised position out of the water.

An object of the present invention is the provision of an improved boat hoist for mounting on a dock.

Another object of the present invention is the provision of an improved boat hoist utilizing an outer, single post adjustably mounted on the water bottom.

Yet another object of this invention is the provision of such a hoist which utilizes a main, dock connected post not mounted on the water floor and connected to the outer post by a single lower frame member.

Still another object of this invention is the provision of a single, outwardly extended platform element slidably connected between the main and outer posts, for supporting a parallel bunk unit.

Another object of this invention is the provision for this type boat hoist of a winch and cable arrangement for effecting a level lifting of the platform element and bunk unit.

BRIEF DESCRIPTION OF THE DRAWINGS

These and other attributes of the invention will become more clear upon making a thorough review and study of the following description of a preferred embodiment, particularly when reviewed in conjunction with the drawings, wherein.

BEST MODE FOR CARRYING OUT THE INVENTION

Figure 1:
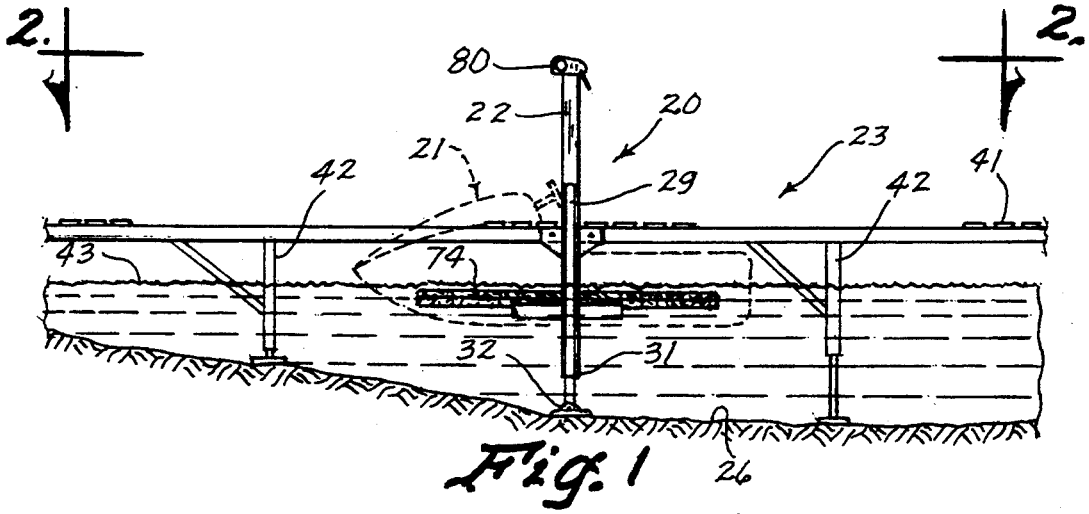
FIG. 1 is an end elevational view of the boat hoist of this invention mounted along the side of an elongated dock supported on the bottom of a body of water, and showing in dashed lines a personal watercraft supported on the hoist.

Referring now to the drawings wherein like reference numerals designate identical or corresponding parts throughout the several views, FIG. 1 shows a boat hoist (20) for supporting a personal watercraft (21), which boat hoist (20) comprises a main vertical post (22) secured to an adjacent dock (23), with the lower end (24) of the main post (22) spaced above the bottom (26) of the water; the boat hoist (20) comprising further a framework (27) including an outer post (28) having an upper end (29) out of the water and a lower end (31) resting on the water bottom (26) by an adjustable pad unit (32), and a member (33) interconnecting the main post (22) and the outer post (28) such that the member

(33) extends outwardly from the dock (23) at substantially right angles therewith.

The hoist (20) includes further a watercraft supporting unit (34) mounted on a platform unit (36) with an inner end (37) of the platform unit (36) slidably connected with the main post (22) and an outer end (38) thereof slidably connected with the outer post. The hoist (20) includes further a winch and cable unit indicated generally at (39) in FIG. 4 which is operably connected in a manner described more in detail hereinafter with the elements of the hoist (20) for effecting a raising and lowering of the platform unit (36) and the boat supporting unit (34) between a lowered position within the water to a raised position out of the water.

Figure 2:
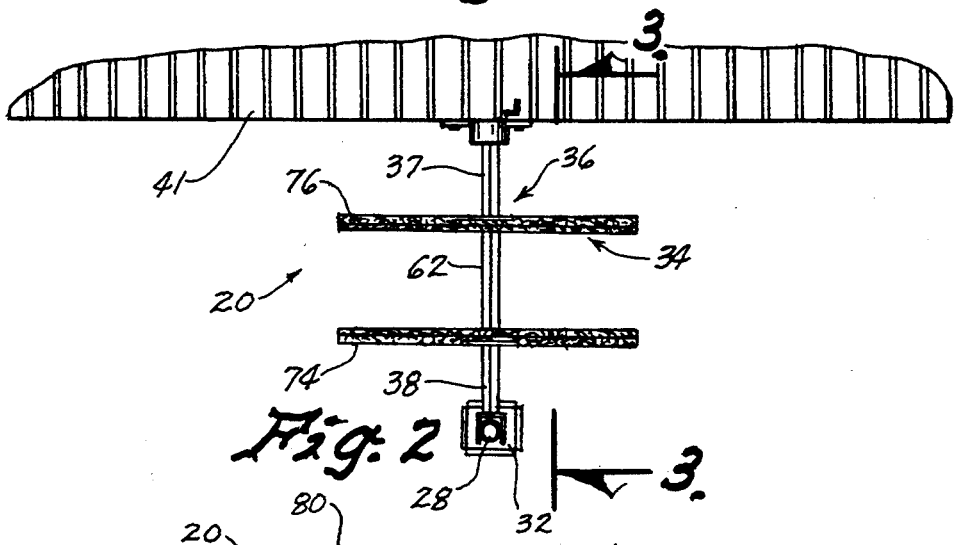
FIG. 2 is a plan view as taken along the line 2—2 in FIG. 1.

The dock (23) as best shown in FIGS. 1 and 2, includes an elongated, horizontally disposed deck (41) supported in a level manner on the bottom (26) of the water by means of a plurality of supports (42) such that the deck (41) is maintained normally spaced well above a level (43) of the water to account for normal changes in same. The main post (22) is mounted on the deck (41) in a vertical manner by a post plate (44) (FIG. 5) secured to the deck (41), with a pair of clamps (46) securing the main post (22) to the post plate (44) for vertical, adjustable mounting.

Referring to FIGS. 9–12, the main post (22) is shown to have a rectangular shape, and is comprised of a rear panel (47) with laterally spaced side panels (48′) and (48″), with a front panel (49) formed to include an oval-shaped hollow portion (51) extended into the interior of the post (22), the portion (51) having an opening (52) formed in the front panel (49). The rear panel (47) includes side extensions (53) (FIGS. 9 and 10) outwardly and beyond the side panels (48′), (48″) to provide for the mounting of the clamps (46) (FIG. 5) for slidably supporting the post (22) against the mounting plate (44).

Figure 6:
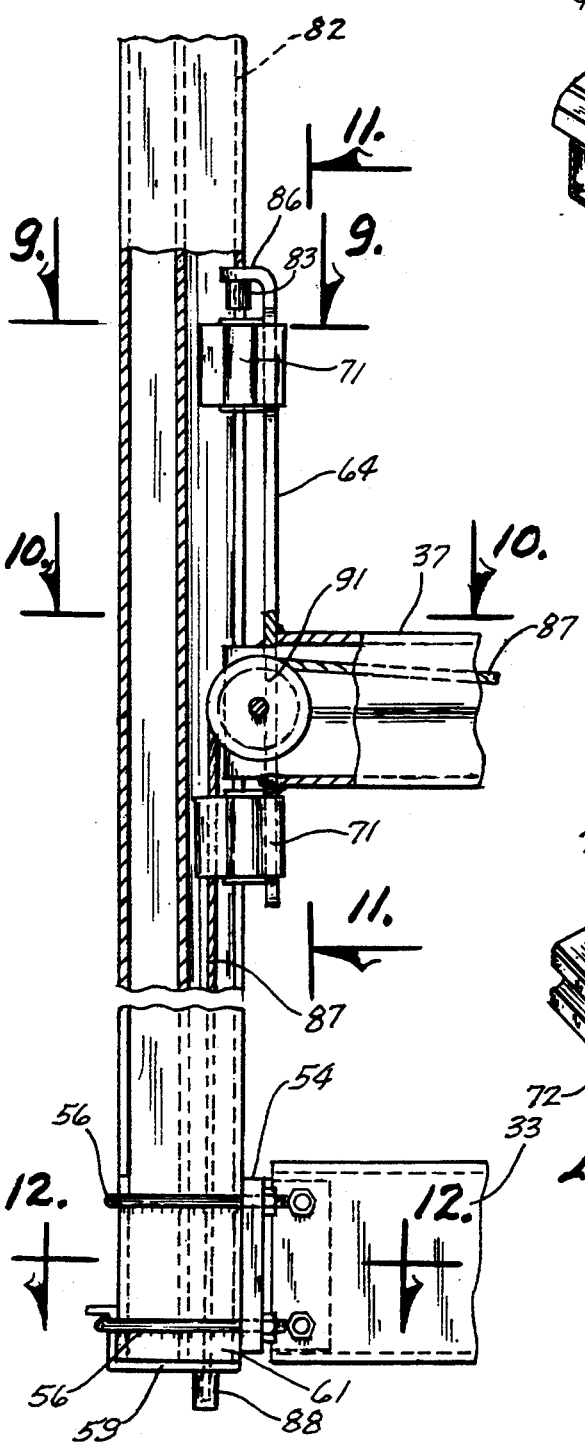
FIG. 6 is a further enlarged detail, elevational view of portions of FIG. 5, with certain parts broken away for clarity of illustration.
Figure 14:
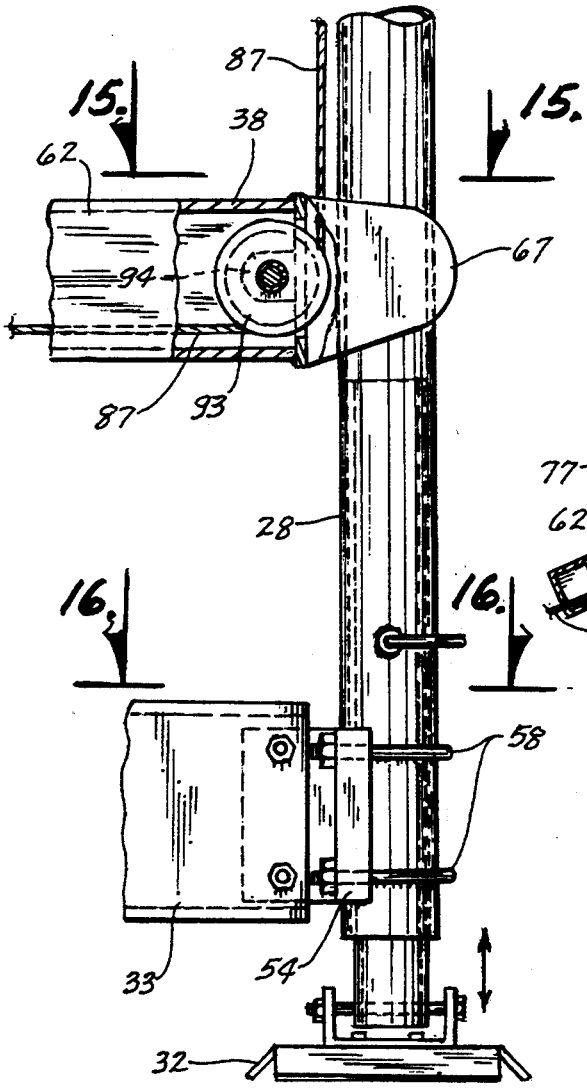
FIG. 14 is an enlarged elevational view as taken along the line 14—14 in FIG. 13.
Figure 13:
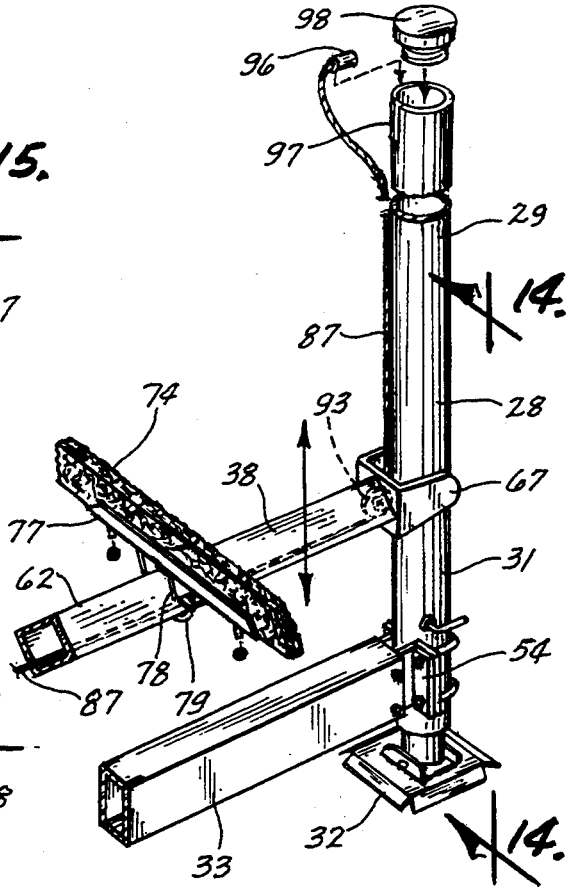
FIG. 13 is a perspective view of a portion of the hoist at the lower end of the outer post.
Figure 15:
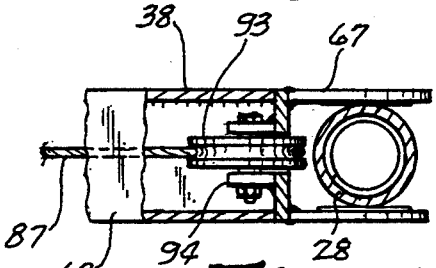
FIG. 15 is a horizontal sectional view as taken along the line 15—15 in FIG. 14.
Figure 16:
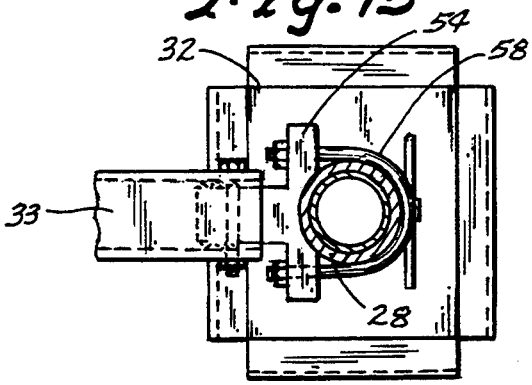
FIG. 16 is a horizontal sectional view as taken along the line 16—16 in FIG. 16.

The framework (27), in addition to the elongated, circular outer post (28) (FIG. 13), includes the lower frame member (33) which is secured by a pair of extrusions (54) at each end (FIGS. 6 and 14), with square U-bolts (56) securing the inner end extrusion (54), and circular U-bolts (58) securing the outer end extrusion (54) to the respective main post (22) and outer post (28). Further, a cable mounting bracket (59) (FIG. 6) is secured in place to the bottom (61) of the main post (22) as by one of the U-bolts (56) for a purpose described hereinafter.

Figure 7:
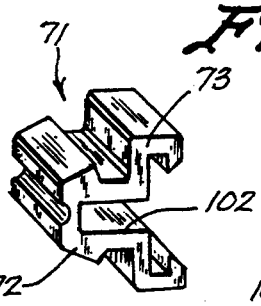
FIG. 7 is an even larger perspective view of a slide connector block.
Figure 8:
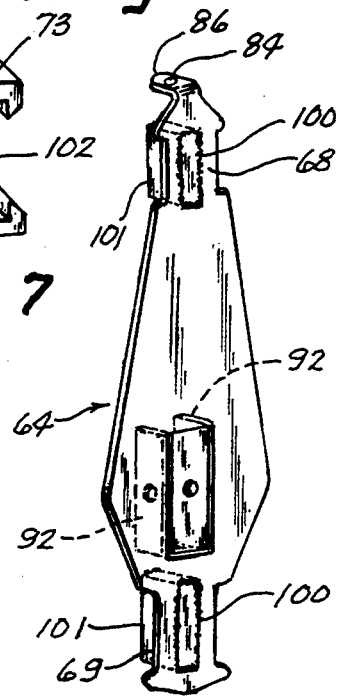
FIG. 8 is a similarly enlarged view of a platform lift plate.
Figure 9:
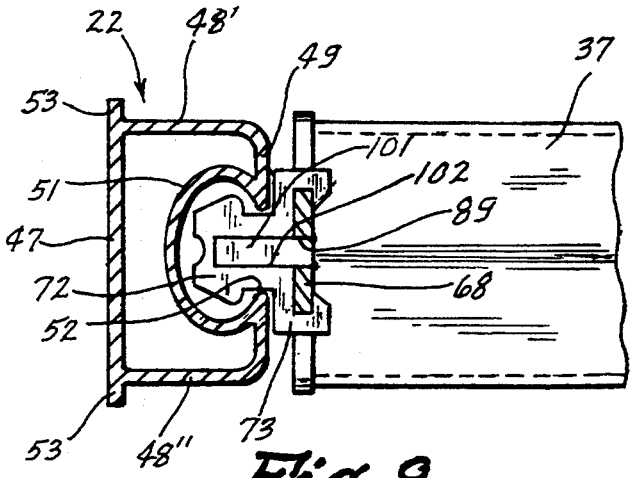
FIG. 9 is a horizontal sectional view as taken along the line 9—9 in FIG. 6.

The supporting unit (34) comprises an elongated platform tube (62) (FIG. 3) of a-square shape in cross section, the tube (62) having the inner end (37) (FIG. 10) secured as by weldments to a lifting plate (64) (FIGS. 8 and 11), with the outer end (38) of the platform tube (62) secured again by weldments (FIG. 14) to a U-shaped guide plate (67) (FIGS. 13 and 14) which embraces the outer post (27) for providing a sliding connection at the outer end (38) of the platform tube (62) with the outer post (28). The lifting plate (64) (FIG. 8) includes upper and lower ends (68) and (69), each of which has a notch (100) formed therein and into which a plate (101) (FIG. 9) is welded for connection with an extruded NYLATRON blocks (71). Each block (71) has an inner portion (72) (FIG. 7) which is slidably received within the oval-shaped portion (51) (FIG. 9) of the main post (22), with each block (71) further having further an outer portion (73) (FIG. 9) which is clamped about and to the upper and lower ends (68), (69) of the lifting plate (64) (FIGS. 6 and 9), each plate (101) fitting into a respective slot (103) formed in each block (71). The lifting plate (64) thus carries the torque load if the personal watercraft (21) is loaded heavier on one end of the supporting unit (34) than the other. The plastic blocks (71) prevent galling of the metal an keep the platform unit (36) in position by securing the lifting plate (64) in an upright position.

Figure 3:
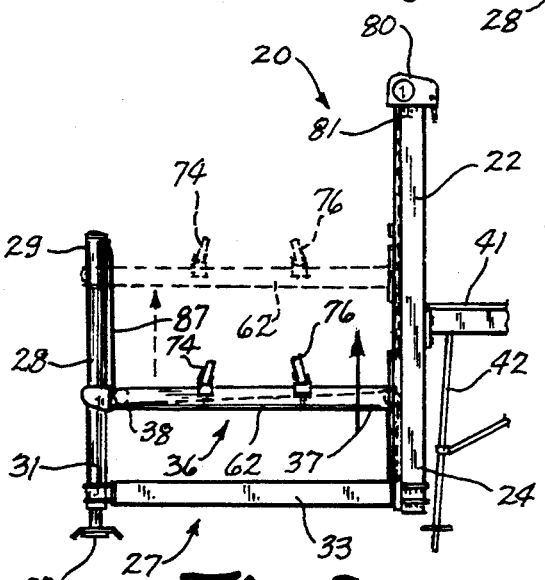
FIG. 3 is an elevational view as taken along the line 3—3 in FIG. 2.
Figure 11:
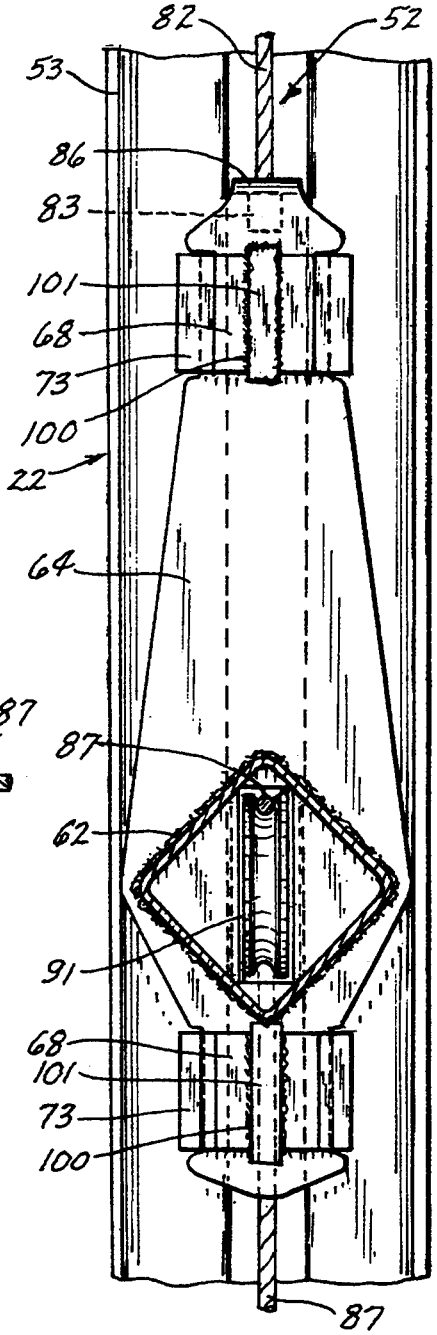
FIG. 11 is a vertical sectional view as taken along the line 11—11 in FIG. 6.

The platform unit (36) comprises a pair of elongated bunks (74), (76) (FIG. 2) mounted in transversely spaced parallel relationship to each other and at right angles to the platform tube (62) (FIGS. 2 and 3), each bunk (74), (76) being supported by an elongated channel member (77) (FIG. 5) secured in turn by a bracket (78) to the platform (62) as by the U-bolts (79). Referring to FIGS. 5 and 11, it will be noted that the platform tube (62) is secured such that it has a diamond shape in cross section, and the brackets (78) have a W-shape for supporting the channels (77) and bunks (74), (76) in a horizontally disposed manner as best illustrated in FIGS. 3–5.

Figure 4:
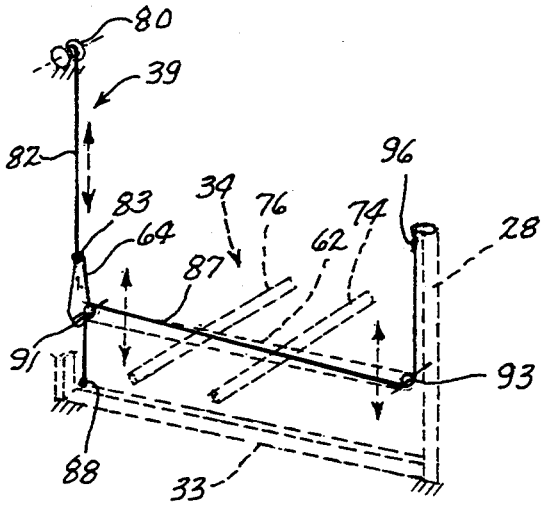
FIG. 4 is a schematic view showing the detail of a winch and cable arrangement, with portions of the hoist shown in dashed lines.
Figure 5:
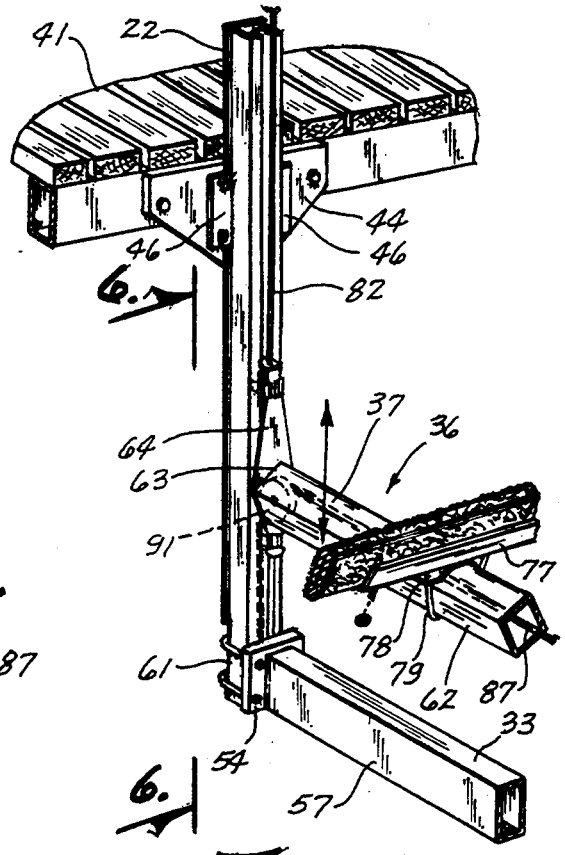
FIG. 5 is an enlarged, detail, perspective view of a portion of the hoist as to the lower end of the main post.

Referring to FIG. 4, the winch and cable unit (39) is comprised of a conventional brake winch unit (80) secured to the upper end (81) (FIG. 3) of the main post (22), with a first cable (82) connected in a conventional manner to the winch unit (80), the lower end (83) (FIG. 6) of the cable (82) passing through an opening (84) (FIG. 8) formed in a flange (86) of the lifting plate such that upon upward movement of the cable (82) by operation of the brake winch unit (80), the lifting plate (64) is raised according to the extent of lifting of the winch unit (79).

Figure 10:
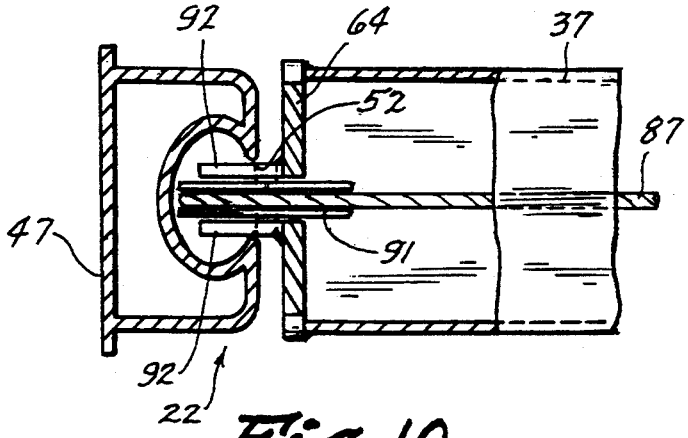
FIG. 10 is a horizontal sectional view as taken along the line 10—10 in FIG. 6.
Figure 12:
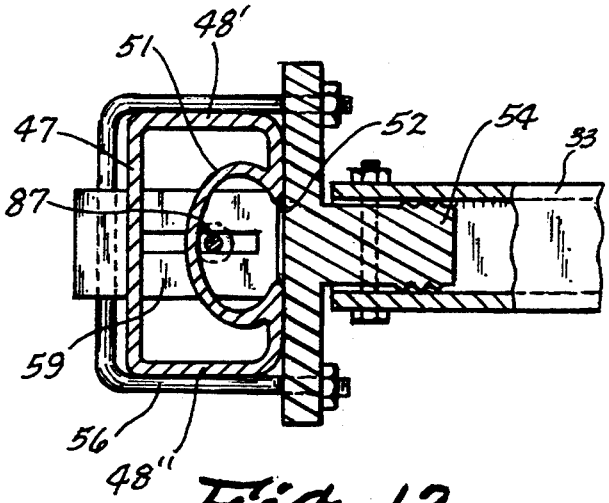
FIG. 12 is a horizontal sectional view as taken along the line 12—12 in FIG. 6.

The winch and cable unit (39) includes additionally a second cable (87) (FIG. 4) with a lower end (88) secured to the cable mounting bracket (59) (FIGS. 6 and 12) trained upwardly through the oval-shaped portion (51) (FIG. 12) of the main post (22), trained upwardly further through the slot (89) formed in the lower block (71) (FIG. 6), and then trained over a pulley (91) which is mounted by a pair of ears (92) secured to the lifting plate (64) (FIG. 10). The second cable (87) is then extended outwardly through the interior of the tube (62) (FIG. 5) to under an outer pulley (93) (FIG. 14), the pulley being rotatably secured to a pair of ears (94) secured to the guide plate (67), with the second cable (87) then trained upwardly to an end (96) which is secured within a slot (97) formed in the upper end (29) of the outer post (28), the upper end (96) being further secured by a cap (98) affixed to the top of the outer post (28).

By this arrangement of the winch and cable unit (39), operation of the brake winch unit (79) effects a level, lifting of the platform unit (36) and supporting unit (37) relative to the stationary framework (27), and between positions where the platform unit (36) is lowered within the water (FIG. 1), and to a raised position wherein the platform unit (36) may be placed adjacent and level with the deck (41).

Obviously, many modifications and variations of the present invention are possible in light of the above teachings. It is therefore to be understood that, within the scope of the appended claims, the invention may be practiced otherwise than as specifically described.

I claim:

1. A boat hoist for use with a dock comprising in combination:

a vertical main post mounted on the dock with a lower end disposed above the floor of the water, and having an upper end;

frame means including an outer vertically disposed guide post having a lower end disposed on the water floor, and a frame member secured to and interconnecting said main post and said guide post;

horizontally disposed platform means attached to said main post and to said guide post, said platform means movable in a vertical direction between a lowered position and a raised position; and winch and cable means interconnected between said main post and said platform means for lifting said platform means from said lowered position to said raised position.

2. The invention of claim 1, and further wherein said main post having a slot formed in a face portion thereof facing away from the dock; and wherein said platform means includes a single member having an inner end with a vertically disposed plate slidably secured in said slot, and having an outer end slidably mounted on said guide post.

3. The invention of claim 2, and with said winch and cable means including a winch mounted on said main post upper end, a first cable secured between said winch and said member inner end, a first pulley mounted on said member inner end within said plate, a second pulley mounted on said outer end, and a second cable secured at one end to said main post lower end, trained over said first pulley and extended through said member, trained under said second pulley and secured at an opposite end to said guide post upper end.

4. The invention of claim 3, and further wherein bunk means are secured to said platform means for supporting a boat thereon.

5. The invention of claim 1, and further wherein bunk means are secured to said platform means for supporting a boat thereon.

6. The invention of claim 5, and further wherein said main post having a slot formed in a face portion thereof facing away from the dock; and wherein said platform means includes a single member having an inner end with a vertically disposed plate slidably secured in said slot, and having an outer end slidably mounted on said guide post.

7. The invention of claim 6 and further wherein said bunk means are secured to said single member for supporting a boat thereon.

* * * * *